United States Patent [19]

Münch et al.

[11] 4,192,169

[45] Mar. 11, 1980

[54] APPARATUS FOR DRIVING A PAIR OF GRIPPER BARS IN A LONGITUDINAL DIRECTION

[75] Inventors: Werner Münch; Gerald Mikusch, both of Göppingen, Fed. Rep. of Germany

[73] Assignee: L. Schuler GmbH, Fed. Rep. of Germany

[21] Appl. No.: 940,092

[22] Filed: Sep. 6, 1978

[30] Foreign Application Priority Data

Sep. 7, 1977 [DE] Fed. Rep. of Germany ..... 2740211

[51] Int. Cl.[2] ..... B21D 43/05; B65G 25/04

[52] U.S. Cl. ..... 72/405; 72/421

[58] Field of Search ..... 72/405, 404, 421, 419; 198/621

[56] References Cited

U.S. PATENT DOCUMENTS

| | | | |
|---|---|---|---|
| 3,011,464 | 12/1961 | Danly | 72/405 |
| 3,105,399 | 10/1963 | Strugala | 72/405 |
| 3,422,657 | 1/1969 | Grombka | 72/421 |
| 3,434,328 | 3/1969 | Taniguchi | 72/405 |
| 3,503,491 | 3/1970 | Taniguchi | 198/621 |
| 4,012,937 | 3/1977 | Imanishi | 72/421 |

FOREIGN PATENT DOCUMENTS

| | | |
|---|---|---|
| 270636 | 2/1914 | Fed. Rep. of Germany . |
| 1000004 | 6/1957 | Fed. Rep. of Germany . |

*Primary Examiner*—Francis S. Husar
*Assistant Examiner*—Gene P. Crosby
*Attorney, Agent, or Firm*—Craig and Antonelli

[57] ABSTRACT

An apparatus for driving a pair of gripper bars of a multi-stage press in a longitudinal direction of the press which includes a pair of driven levers disposed symmetrically to a longitudinal center plane of the press, which levers are engageable with a slide guide extending at right angles to the longitudinal direction of the press. At least one feed cross member is operatively connected to the pair of gripper bars and also to the slide guide associated with the pair of driven levers. Two toothings are provided which are disposed symmetrically to the longitudinal center plane and are conjointly reciprocatingly driven between two end positions. Each toothing meshes with a pinion mounted for rotation and fastened to the frame with the pinions having a rotational path between the two end positions of the toothing which amounts to 180°. Each pinion is also rotationally fixed to one of the pair of driven levers.

5 Claims, 9 Drawing Figures

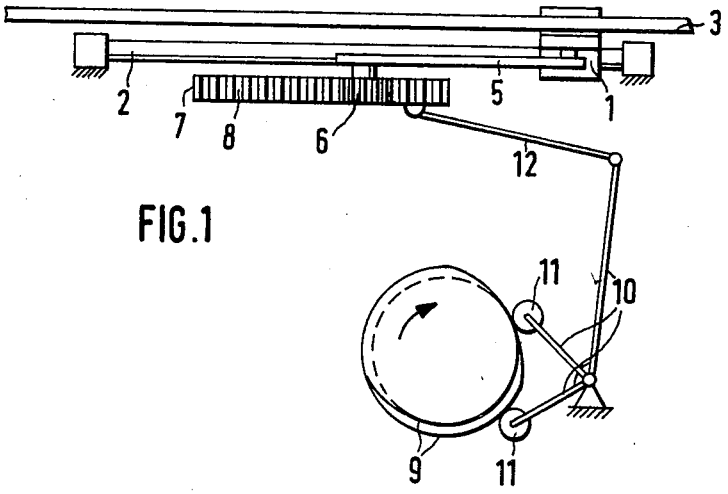
FIG.1
FIG.2
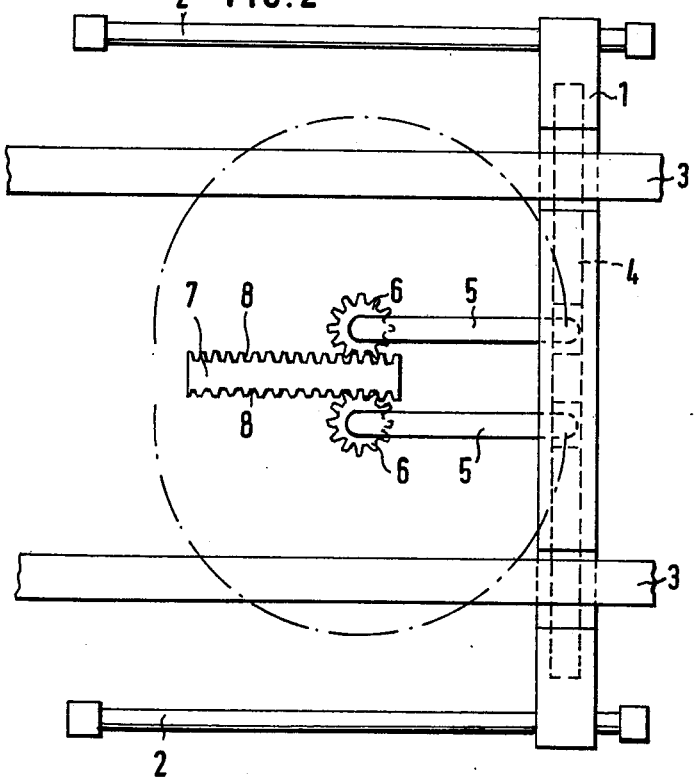

FIG. 5
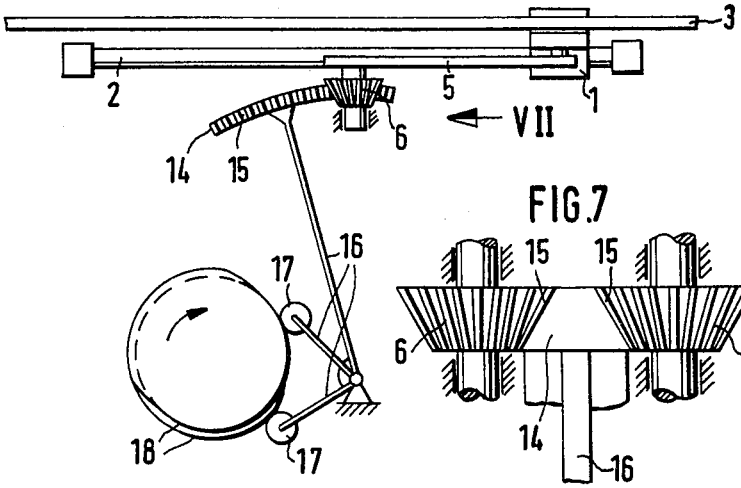
FIG. 7
FIG. 6
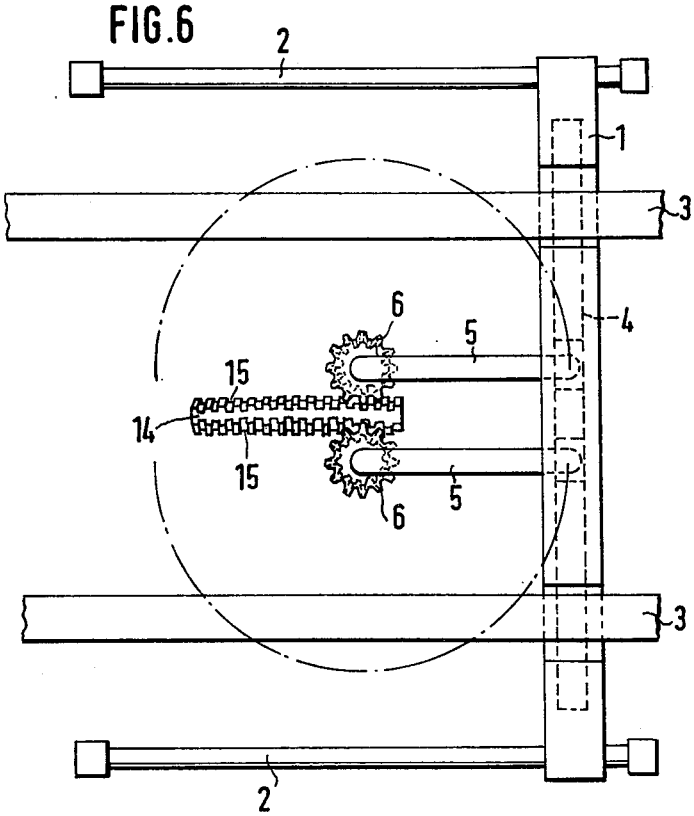

APPARATUS FOR DRIVING A PAIR OF GRIPPER BARS IN A LONGITUDINAL DIRECTION

The present invention relates to a drive arrangement and, more particularly, to an apparatus for driving a pair of gripper bars of a multi-stage press in a longitudinal direction parallel to a sequence of press stages by way of a pair of driven levers, disposed symmetrically to a longitudinal center plane of the press, which levers are pivotable in unison over a path of 180°.

In German Patent Specification No. 270,636, a drive apparatus of the afore-mentioned type is proposed wherein two pairs of levers are disposed for pivotal movement in pairs in opposite directions along a common horizontal plane so as to execute a complete revolution with a portion of each revolution, namely, a rotational path of 180° necessary for the movement of the gripper rails in the longitudinal direction, which is in each case remote from the longitudinal center plane, serving to produce movements of the gripper bars in the transverse direction. In this proposed construction, the levers act on end stops provided in slide guides, remote from the longitudinal center plane, and move the gripper bars in a longitudinal direction and simultaneously in a transverse direction while springs act on the gripper bars so as to force the gripper bars transversely in the direction of the longitudinal center plane. One disadvantage of this proposed construction resides in the fact that it is impossible to obtain an exactly parallel guidance of the gripper bars if it is necessary to apply considerable forces for the movements of the gripper bars in the longitudinal and/or transverse directions. The application of considerable forces may be necessitated due to, for example, the dimensions and, in particular, the length of the gripper bars and/or the occurrence of high frictional resistances due to other factors.

Drive apparatus for driving a pair of gripper bars of a multi-stage press in a longitudinal direction have also been proposed in German Patent Specification No. 1,000,004, Auslegeschrift 16 27 455, U.S. Pat. No. 3,503,491, Offenlegungsschrift 26 13 269, and U.S. Pat. No. 4,012,937, wherein a slide guide is provided in a feed cross member which is adapted to be reciprocatingly movable in a longitudinal direction between two end positions with the movements in the longitudinal direction being transmitted to two gripper bars. In these constructions, in each case, a lever engages in the slide guide with a transmission element of the lever, engaging in the slide guide, passing on each revolution through a path curve which lies symmetrically to a longitudinal center plane of the press with the length, in the longitudinal direction, determining the length of movements of the gripper bars in the longitudinal direction.

These last-mentioned constructions have a common disadvantage in that the transmission element acts on the slide guide on a side of the longitudinal center plane during one-half of each rotational path of the lever and on the other side of the longitudinal center plane during the other half of the rotational path. Consequently, the forces transmitted by the lever to the feed cross member for producing movements of the feed cross member in the longitudinal direction act asymmetrically so that there is a danger of a jamming, particularly if considerable forces have to be applied for the movements of the gripper bars in the longitudinal direction.

The aim underlying the present invention essentially resides in providing a driving apparatus for driving a pair of gripper bars of a multi-stage press in the longitudinal direction which assures the achievement of correct movement conditions in the driving of the gripper bars in the longitudinal and transverse directions.

The present invention is based on the assumption that in order to achieve correct movement conditions, the driving of the gripper bars in the longitudinal and transverse directions must be effected separately from one another and that the driving apparatus must be arranged symmetrically to a longitudinal center plane of the press; however, it is understood that obviously slight deviations from symmetry can be regarded as harmless or having little effect on the correct movement conditions.

In accordance with the present invention, an apparatus is provided for driving a pair of gripper bars of a multi-stage press in the longitudinal direction parallel to the sequence of stages of the multi-stage press by means of a pair of driven levers which are disposed symmetrically to a longitudinal center plane of the press with the levers being pivotable in unison over a turning path or path of rotation of 180°. The levers engage in a slide guide which extends at right angles to the longitudinal direction with the movement of the slide guide in the longitudinal direction being transmitted to the gripper bars. At least one feed cross member is provided which is common to both gripper bars and is connected to the slide guide associated with the two levers. Two toothings are provided which are disposed symmetrically to the longitudinal center plane of the press and are conjointly reciprocatingly driven between two end positions. Each toothing meshes with a pinion which is mounted for rotation and is fastened to the press frame, with each of the pinions having a rotational path between two end positions of the driven toothing, which rotational path amounts in each case to 180°. Additionally, each pinion is rotationally fixed to one of the two levers.

By virtue of the above arrangement in accordance with the present invention, the feed cross member effects the driving of the gripper bar in the longitudinal direction separately from the driving of the cross member in the transverse direction. At the same time, with a symmetrical construction of the driving apparatus, by utilizing a rotational path of the levers of only 180° in each case, the movements of the gripper bars in the longitudinal direction take place exactly between the end positions provided in which the levers are at a right angle to the slide guide. In this arrangement, it is necessary to be able to effect a variation of the length of movements of the gripper bars in the longitudinal direction by varying the effective length of the levers by, for example, adjusting a transmission element on each lever.

In accordance with further features of the present invention, the two levers are mounted for pivoting in opposite directions in a common horizontal plane with the slide guide being provided in the feed cross member and the two toothings being disposed on each side of a rack guided for rectilinear displacement in the longitudinal center plane of the press. An advantage of the guidance of the rack in the longitudinal center plane of the press resides in the fact that the two pinions are turned accurately in unison in opposite directions.

While the reciprocating driving of the rack between its two end positions can, in principle, be achieved by conventional means such as, for example, a one-armed lever which is driven by a cam disc system to oscillate in a reciprocating manner with the one-armed lever being joined by means of a link to the rack, in accordance with the present invention, a multi-armed lever is provided wherein separate rollers, arranged on free ends to two of the arms, engage the cam discs so as to cause a reciprocating movement of another arm of the multi-armed lever which is connected to the rack by way of linkage or the like. By virtue of the provision of the multi-armed lever, a more accurate and positive interconnection is provided between the cam disc system and the rack.

In accordance with yet further features of the present invention, a third toothing is provided on a lower face of the rack, which toothing is adpated to be engaged by a toothed segment driven to and fro in an oscillating manner. By virtue of this construction, advantageously, a direct reciprocable driving of the rack is effected by means of the toothed segment.

In lieu of the rack guided for rectilinear displacement, the same advantage of the present invention may also be achieved with the two levers being mounted for pivoting or rotational movement in opposite directions in a common horizontal plane and with the slide guide being provided in the feed cross member if two toothings are mounted on a segment which is disposed in the longitudinal center plane and is rotatable about a horizontal axis lying at the bottom with the two toothings being in the form of outwardly inclined bevel toothings engageable by bevel toothings provided on the pinions rotatably mounted at the respective levers. The driven segment oscillates and transmits such oscillation by the two toothings located thereon to the bevel toothings of the pinions so as to cause a displacement of the two levers disposed symmetrically with respect to the longitudinal center plane of the press.

According to yet additional features of the present invention, the two levers are disposed for a pivoting or rotational movement in the same direction in two vertical planes lying symmetrically with respect to the longitudinal center plane of the press. The slide guide is provided in a vertical guide carrier which lies in the longitudinal center plane of the press and which is fastened on the feed cross member. Two toothings are disposed on two segments which are conjointly pivotable or rotatable about a horizontal axis lying at the bottom of the press and which occupy vertical planes lying symmetrically in the longitudinal center plane outside of the planes of the two levers. By virtue of this arrangement, a compact construction for the driving apparatus is realized because of the position of the guide carrier and levers, as well as of the pinions and segments with the toothings in vertical planes parallel to one another.

Accordingly, it is an object of the present invention to provide a driving apparatus for gripper bars of a press which avoids, by simple means, the shortcomings and disadvantages encountered in the prior art.

Another object of the present invention resides in providing a driving apparatus for gripper bars of a press which functions reliably under all operating conditions, even with the occurrence of considerable forces.

A further object of the present invention resides in providing a driving apparatus for gripper bars of a press which ensures the achievement of correct movement conditions for the driving of the gripper bars.

An additional object of the present invention resides in providing a driving apparatus for gripper bars of a press which minimizes, if not avoids, the possibility of a jamming of the drive elements of the driving apparatus.

Yet another object of the present invention resides in providing a driving apparatus for gripper bars of a press which permits an exact parallel guidance of the gripper bars.

A still further object of the present invention resides in providing a driving apparatus for gripper bars of a press which is simple in construction and, therefore, inexpensive to manufacture.

These and other objects, features and advantages of the present invention will become more apparent from the following description when taken in connection with the accompanying drawings which show, for the purposes of illustration only, several embodiments in accordance with the present invention, and wherein:

FIG. 1 is a schematic side view of a driving apparatus in accordance with the present invention;

FIG. 2 is a plane view of the driving apparatus of FIG. 1;

FIG. 5 is a side view of a further embodiment of a driving apparatus in accordance with the present invention;

FIG. 6 is a plan view of the driving apparatus of FIG. 5;

FIG. 7 is a detail view taken in the direction of arrow VII in FIG. 5;

Figure 3:
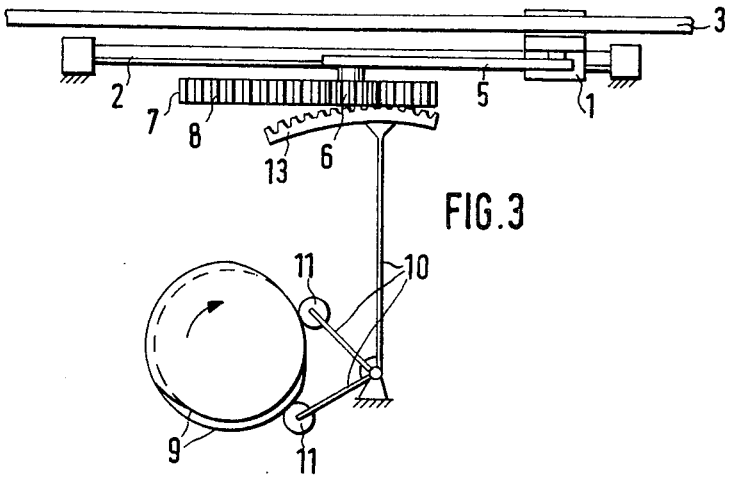
FIG. 3 is a side view of another embodiment of a driving apparatus in accordance with the present invention.

Referring now to the drawings wherein like reference numerals are used througout the various views to designate like parts and wherein, for the sake of clarity, the multi-stage press, means for moving the gripper bars in the transverse direction, and means for raising and lowering the gripper bars are not illustrated and, in particular, to FIGS. 1 and 2, a horizontal feed cross member 1, extending in a transverse direction of a press (not shown), is guided on horizontal guide rods 2, extending in the longitudinal direction of the press, provided on each side of a longitudinal center plane of the press. A horizontal gripper bar 3, provided on each side of the longitudinal center plane of the press, engages in the horizontal feed cross member 1 with the gripper bars 3 extending in the longitudinal direction. The gripper bars 3 participate in the movements of the horizontal feed cross member 1 in the longitudinal direction and are also displaceable relative to the horizontal feed cross member 1. Gripping means (not shown) for gripping workpieces to be conveyed are secured on the gripper bars 3 in a conventional manner.

Figure 4:
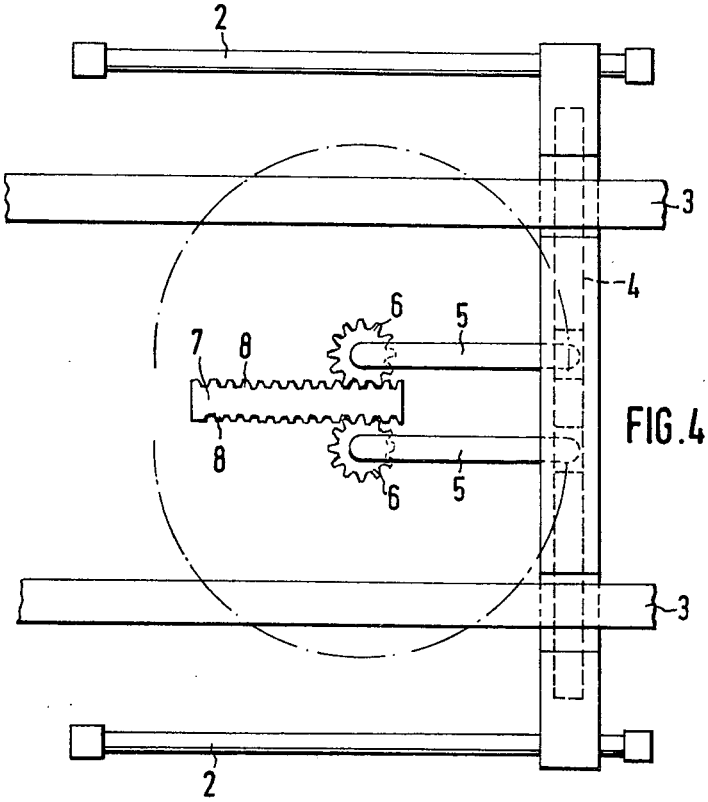
FIG. 4 is a plan view of the driving apparatus of FIG. 3.

In the arrangements illustrated in FIGS. 1–7, the horizontal feed cross member 1 is provided on a lower side thereof with a slide guide 4 in which is engaged two levers 5 which are pivotable or swivelable in unison and in opposite directions by 180° with the path of movement of the levers 5 being illustrated in phantom line in FIGS. 2, 4 and 6. In each case, the two levers 5 are movable in a horizontal plane and are rotatably mounted in bearings (not shown) fastened to the press frame with each lever 5 having a pinion 6 rotatably mounted at a free end thereof.

As shown in FIGS. 1–4, a rack 7 is mounted on the press frame and guided for reciprocatory horizontal rectilinear motion in the longitudinal center plane of the press. The rack 7 is provided with a toothing 8 on both sides thereof, which toothing 8 is adapted to mesh with the pinions 6 mounted at the free ends of the levers 5.

As shown most clearly in FIGS. 1 and 3, a cam disc system is provided for reciprocatorily driving the rack 7 between two end positions. The cam disc system includes two rotatably driven cam discs 9 cooperable with a three-armed drive lever 10. A roller 11 is rotatably mounted on the free end of two arms of the drive lever 10 with the rollers 11 engaging the cam surface of the cam discs 9.

In the arrangement of FIGS. 1 and 2, the third arm of the two-armed lever 10 is an upwardly directed arm which is connected to the rack 7 by a link 12.

In lieu of the link 12, as shown in FIG. 3, a toothed segment 13 may be provided on the upwardly directed third arm of the three-armed lever 10 with the segment 13 being arranged so as to mesh with a third toothing provided on a lower side of the rack 7.

As shown in FIGS. 5–7, a segment 14, rotatable or swivelable about a horizontal axis lying at the bottom of the press, is provided in the longitudinal center plane of the press. The segment 14 has two outwardly inclined bevel toothings 15 arranged at the top thereof with each of the toothings 15 meshing with a bevel toothing on one of the two pinions 6 rotatably mounted at each of the levers 5. The segment 14 is fastened or otherwise secured on an upwardly directed arm of a three-armed drive lever 16. Each of the other arms of the three-armed drive lever 16 carries a roller 17 adapted to roll along or engage on one of the two cam discs of a rotationally driven cam disc system.

As readily apparent from an inspection of FIGS. 1–6, the rotation of the cam disc system results in the upwardly directed arm of the three-armed lever 10 or 16 being oscillated to and fro, thereby resulting in the reciprocation of the rack 7 or segment 14 with such motion being transmitted by way of pinions 6 to the levers 5 so as to cause the levers to be displaced over a path of 180° between two end positions of the rack 7 or toothed segment 14.

Figure 8:
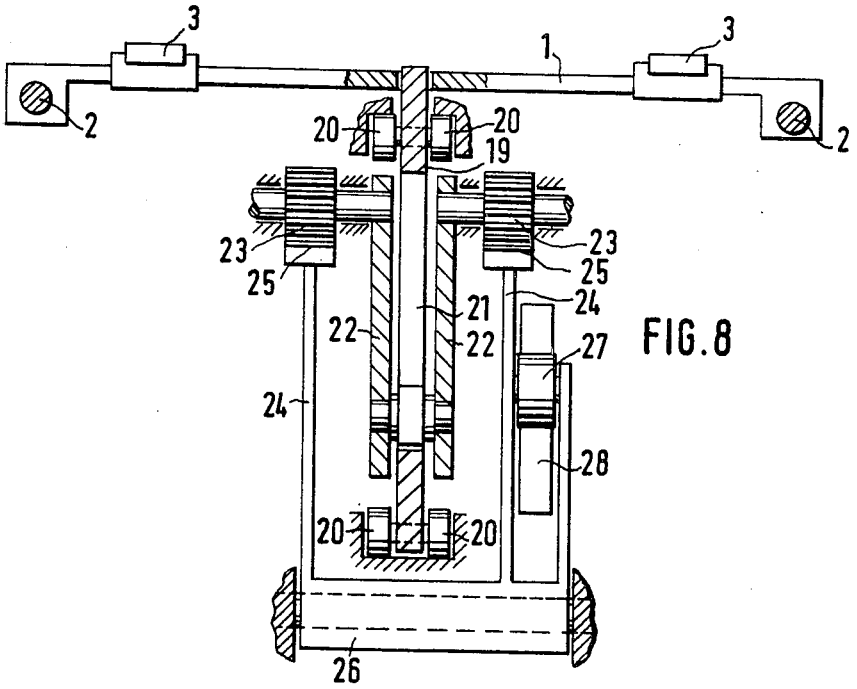
FIG. 8 is a side view of a further embodiment of a driving apparatus in accordance with the present invention viewed in the direction of arrow VIII in FIG. 9.
Figure 9:
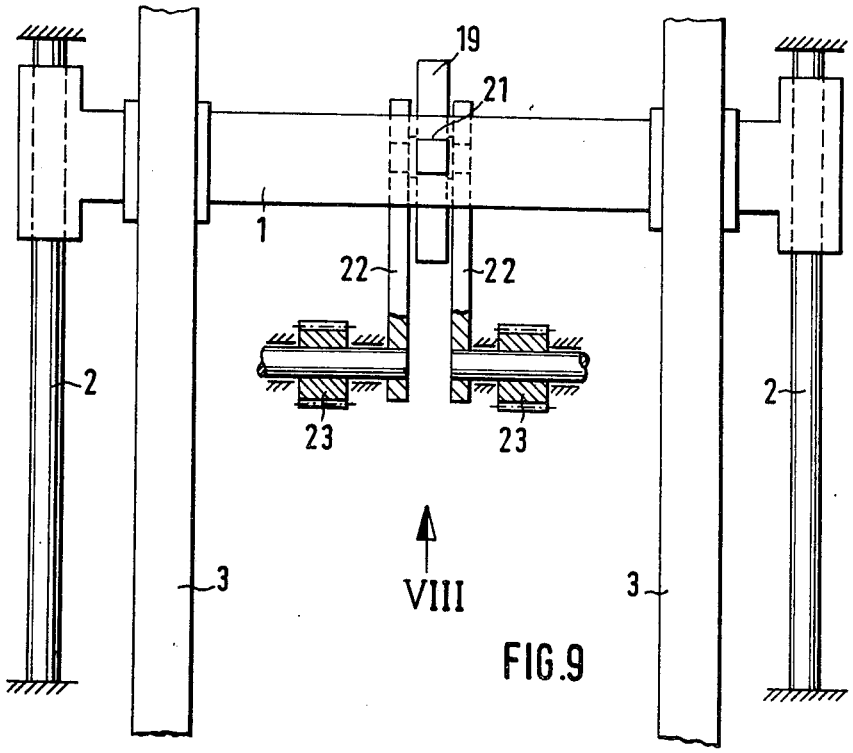
FIG. 9 is a plan view of the driving apparatus of FIG. 8.

As shown in FIGS. 8 and 9, a guide carrier 19 is fastened or otherwise secured on the feed cross member 1 in the longitudinal center plane of the press. The guide carrier 19 extends in a vertical plane downwardly with the top and bottom of the guide carrier 19 being guided in guides 20 fastened to the press frame. The guide carrier 19 is provided with a slot-shaped slide guide 21 which extends along a vertical plane. Two levers 22 are rotatable or swivelable in the same direction about a horizontal axis in vertical planes lying symmetrically to the longitudinal center plane of the press with the two levers engaging in the slide guide 21. A pinion 23 is rotationally fixed to each lever 22 with the pinions 23 being disposed in planes lying symmetrically to the longitudinal center plane of the press outside of the planes of the levers 22. A toothing 25 provided on a segment 24 in the same plane meshes with each pinion 23. Two segments 24 are fastened on a common carrier 26 and are rotatable or swivelable together with the carrier 26 about a horizontal axis lying at the bottom of the press. A roller 27 is mounted on the carrier 26 with the roller 27 engaging a cam surface of a rotatably driven cam disc 28.

While the above description refers to a "multi-stage press", it is understood that the present invention is applicable to a line of individual serially disposed presses through which workpieces are conveyed by means of a pair of gripper bars.

Although we have shown and described several embodiments in accordance with the present invention, it will be appreciated that the same is not limited thereto, but is susceptible of numerous changes and modifications as known to one having ordinary skill in the art, and we therefor do not with to be restricted to the details shown and described herein, but intend to cover all such changes and modifications as are encompassed by the scope of the appended claims.

We claim:

1. An apparatus for driving a pair of gripper bars of a multi-stage press in a longitudinal direction of the press, the apparatus including a pair of driven levers disposed symmetrically to a longitudinal center plane of the press and being rotatable in unison over a turning path of 180°, a slide guide means extending at right angles to the longitudinal direction of the press, the pair of driven levers being operatively connected to the slide guide means, characterized in that at least one feed cross member is operatively connected to a pair of gripper bars and to the slide guide means, two toothings are provided and disposed symmetrically with respect to the longitudinal center plane of the press, the two toothings are mounted so as to be conjointly reciprocatorily driven between two end positions, a rotatably mounted pinion is provided for engaging each of the two toothings, each of the pinions have a rotational path of 180° between the two end positions of the toothings, and in that each of the pinions is rotatably mounted at one end of the pair of driven levers.

2. An apparatus according to claim 1, wherein the pair of driven levers are mounted for rotation in opposite directions along a common horizontal plane, characterized in that the slide guide means is mounted in the feed cross member, and in that the two toothings are disposed on respective sides of a rack guided for rectilinear displacement in the longitudinal center plane of the press.

3. An apparatus according to claim 2, characterized in that a third toothing is provided along a lower surface of the rack, and in that an oscillatingly driven toothed segment meshes with the third toothing so as to cause the rectilinear displacement of the rack.

4. An apparatus according to claim 1, wherein the pair of driven levers are mounted for rotation in opposite directions along a common horizontal plane, characterized in that the slide guide means is mounted in the feed cross member, the two toothings are mounted on a segment disposed in the longitudinal center plane of the press, the segment being rotatable about a horizontal axis lying along a bottom of a press frame, the toothing on the segment being fashioned as inclined bevel gear teeth, and in that the pinions are provided with corresponding inclined bevel gear teeth adapted to mesh with the bevel gear teeth of the segment.

5. An apparatus according to claim 1, characterized in that the pair of driven levers are disposed for rotation in the same direction in two vertical planes lying symmetrically with respect to the longitudinal center plane of the press, the slide guide means is mounted in a vertically extending guide carrier lying along the center plane of the press, the guide carrier is mounted on the feed cross member, and in that the two toothings are disposed on two segments which are conjointly pivotable about a horizontal axis lying along a bottom of a press frame, the two segments being disposed in vertical planes lying symmetrically to the longitudinal center plane of the press outside of the planes in which the pair of driven levers lie.

* * * * *